United States Patent [19]

Anderson

[11] 4,257,904

[45] Mar. 24, 1981

[54] DIELECTRIC GLASS COATING COMPOSITION CONTAINING POLYMETHYLMETHACRYLATE FUGATIVE BINDER

[75] Inventor: Leslie C. Anderson, Kingston, N.Y.

[73] Assignee: International Business Machines Corp., Armonk, N.Y.

[21] Appl. No.: 537,151

[22] Filed: Dec. 30, 1974

[51] Int. Cl.[3] ..... H01B 3/02

[52] U.S. Cl. ..... 260/33.2 R; 174/110 SR; 427/201; 106/49; 260/31.8 G

[58] Field of Search ..... 260/42.54, 42.18, 31.8 G, 260/31.4 R; 252/63.2, 63.5, 64; 174/110 SR; 427/201

[56] References Cited

U.S. PATENT DOCUMENTS

| | | | |
|---|---|---|---|
| 1,980,483 | 11/1934 | Hill | 174/110 SR |
| 2,046,886 | 7/1936 | Strain | 174/110 SR |
| 2,461,878 | 2/1949 | Christensen et al. | 106/1 |
| 3,779,807 | 12/1973 | Taylor | 427/226 |
| 3,975,201 | 8/1976 | Greenstein | 427/226 |

*Primary Examiner*—John D. Welsh

*Attorney, Agent, or Firm*—Edward S. Gershuny

[57] ABSTRACT

A formulation comprising, by weight, 4.7–39.7 percent polymethylmethacrylate (PMMA), 0–9.1 percent plasticizer and 60.3–93.0 percent dielectric glass (along with an appropriate amount of solvent) is ball milled to an appropriate size for spraying. After the formulation is sprayed onto a substrate, it is baked at a temperature of approximately 620° C. for approximately 2 hours. During the baking step, the PMMA decomposes to a methylmethacrylate monomer. The resultant dielectric coating will contain a small amount of residue (less than 1 percent) of the monomer and the plasticizer.

11 Claims, No Drawings

DIELECTRIC GLASS COATING COMPOSITION CONTAINING POLYMETHYLMETHACRYLATE FUGATIVE BINDER

INTRODUCTION

This invention relates to dielectric materials and methods of coating them onto a substrate. More particularly, it is concerned with such materials and methods that are particularly suitable in a process for manufacturing gas discharge display devices.

Processes for applying coatings of dielectric glasses often include one or more grinding steps. A disadvantage of such a step is that it is difficult to prevent contamination of the mixture. Although ball milling is less subject to contamination (i.e., cleaner) than grinding, glass making processes which utilize ball milling of various constituents typically also utilize one or more separate mixing steps after the ball milling. The additional mixing steps introduce further contamination problems.

It is a primary object of this invention to provide a safe and clean method for making a dielectric coating.

A more particular object is to provide a formulation which can be ball milled to proper size and requires no subsequent mixing steps.

Another object is to provide such a formulation which, after ball milling, can be placed on a substrate in tape form or by spraying.

A further object is to provide a formulation which can be reflowed in practically any clean atmosphere (that is, one which is oxidizing, reducing or inert).

Yet another object is to provide a formulation which can be ball milled without degradation of its constituents.

Still further objects include the provision of a dielectric that is relatively free of bubbles and other defects and is of high optical clarity.

SUMMARY OF THE INVENTION

In accordance with preferred embodiments of the invention, a formulation containing, by weight, 4.7–39.7 percent polymethylmethacrylate (PMMA), 0–9.1 percent plasticizer (such as dibutyl phthalate) and 60.3–93.0 percent dielectric glass which melts at a temperature above 375° C. along with an appropriate solvent (such as ethyl cellosolve acetate) is ball milled to an appropriate size for spraying. The spray slurry is then sprayed onto a substrate to an appropriate thickness and heated at a temperature of approximately 620° C. for a period of 2 hours. During heating, the PMMA decomposes back to a methylmethacrylate monomer. The resultant dielectric film will contain trace amounts of the monomer and the plasticizer, but will consist mostly of the dielectric glass.

A primary advantage of this invention is that it provides a safe and clean method for making a dielectric coating.

A more particular advantage is the provision of a formulation which can be ball milled to proper size and requires no subsequent mixing steps.

Another advantage is it procides a formulation which, after ball milling, can be placed on a substrate in tape form or by spraying.

A further advantage is that reflow can be accomplished in a atmosphere that is oxidizing, reducing or inert.

Yet another advantage is that the formulation can be ball milled without degradation of the PMMA or other constituents.

The foregoing and other objects, features and advantages will be apparent from the following more particular description of preferred embodiments of the invention.

DETAILED DESCRIPTION

The first aspect of this invention concerns the preparation of a mixture of polymethylmethacrylate (PMMA), plasticizer and dielectric glass along with a solvent. Table I shows 5 exemplary mixtures of PMMA, plasticizer and glass (grams and percentages) which may be used. All of them consist essentially of the following constituents in the following ranges: 4.7–39.7 percent PMMA; 0–9.1 percent plasticizer; and 60.3–93.0 percent dielectric glass, by weight. The table also shows the amount of solvent that was added to each example.

TABLE I

| | A | B | C | D | E |
|---|---|---|---|---|---|
| PMMA | 50(18.2%) | 10(4.7%) | 59(4.8%) | 46(39.7%) | 50(19.2%) |
| Plasticizer | 25(9.1%) | 5(2.3%) | 30(2.5%) | 0 | 10(3.8%) |
| Dielectric Glass | 200(72.7%) | 200(93.0%) | 1131(92.7%) | 70(60.3%) | 200(76.9%) |
| Solvent | 225 | 285 | 1347 | 230 | 240 |

In preparing the mixture, a linear PMMA of at least 99% purity should be used. In each of the above examples, dibutyl phthalate was used as the plasticizer, but others such as any linear or aromatic plasticizer that is compatible with PMMA could also be used. The solvent used in preparing the above exemplary mixtures was ethyl "Cellosolve" acetate (ethyl glycol monoethyl ether acetate—commonly referred to as ECA), but others such as ketones, esters, alcohols and chlorinated solvents which dissolve PMMA could also be used. However, for safety and health reasons, ECA is preferred. The dielectric glass used in the mixture should be one that melts at a temperature above approximately 375° C. so that it will not begin to melt before the PMMA decomposition is completed. The examples utilized a glass consisting essentially of, by weight, 56.0% PbO, 21.5% $B_2O_3$, 12.0% $SiO_2$, 1.0% $Al_2O_3$, 5.5% CaO, 2.0% MgO and 2.0% $Na_2O$. However, substantially any dielectric glass which melts at above about 375° C. could be used.

After the above-described mixture is prepared, it is ball milled to the correct size. The milling time (typically about 12–36 hours) will depend upon the particle size desired. The desired size will, in turn, depend upon the manner to be used for applying the slurry. In preferred embodiments of the invention, the slurry is applied by spraying. The preferred average distribution of particle size is below 1 micron, which typically requires approximately 24 hours of ball milling. If the milled mixture were to be applied to a substrate in the form of a tape, an average particle size of about 2 microns would be acceptable, and a milling time of approximately 16 hours would be sufficient.

After milling, the mixture is coated onto a substrate (for example, in tape form or by spraying) which is then placed into an oven. The oven temperature is elevated at a rate of approximately 5° C. per minute until it reaches approximately 620° C., which temperature is maintained for a period of approximately 2 hours. The oven is then permitted to cool at a rate of 1° C. per minute until it reaches 375° C., after which it is cooled at a rate of 2° C. per minute until it reaches room temperature.

During the heating step, the solvent will boil away (or it could have previously been dried away), the PMMA will decompose back into methylmethacrylate, and the monomer and plasticizer will boil off except for a very small residue. The resultant dielectric film will therefore be composed of more than 99 percent dielectric glass. Since the decomposition of the polymethylmethacrylate and the boiling off of the methylmethacrylate and the plasticizer are not significantly affected by the atmosphere of the heating chamber, no special atmosphere is required for this step of the process.

In the mixtures described above, the PMMA aids in the formation of the dielectric film. Although the plasticizer could be omitted, the mixture will be too brittle for convenient handling if the amount of plasticizer is less than about 20% of the amount of PMMA. On the other hand, if the amount of plasticizer is significantly more than half the amount of PMMA, the PMMA will tend to be too soft for handling. So far as the solvent is concerned, those skilled in the art will recognize that the amount used will depend upon the method of coating the mixture onto the substrate.

The importance of the ratio of plasticizer to PMMA is illustrated by the properties of the exemplary mixtures. D contains no plasticizer and therefore needs a relatively high percentage of PMMA. This mixture is not well suited to applications in which film thickness must be tightly controlled because the mixture flows too easily. However, this mixture could be utilized in situations where film thickness and uniformity are not critical. E, which has a plasticizer/PMMA ratio of 20%, is more convenient to use because film can be controlled reasonably well. But, even with this ratio, it is somewhat difficult to clean excess glass off the substrate before firing. 20% is therefore the preferred lower limit of the plasticizerPMMA ratio. In examples A, B and C the ratio is about 50–51%. This gives a slurry that is very convenient to handle at room temperature and, for use in manufacturing a gas discharge display device, is the preferred ratio.

While the invention has been particularly shown and described with reference to preferred embodiments thereof, it will be understood by those skilled in the art that the above and other changes is form and detail may be made therein without departing from the spirit and scope of the invention.

What is claimed is:

1. A mixture to be used in coating a substantially uncontaminated dielectric glass film onto a subtrate consisting essentially of the following ingredients in the following proportions:

| Constituents | Percent by Weight |
|---|---|
| linear polymethylmethacrylate | 4.7–39.7 |
| plasticizer | 0.0–9.1 |
| dielectric glass having a melting point above approximately 375° C. | 60.3–93.0 |

2. The mixture of claim 1 wherein said plasticizer is dibutyl phthalate.

3. The mixture of claim 1 further including a solvent consisting essentially of ethyl glycol monoethyl ether acetate.

4. The mixture of claim 1 wherein said mixture consists of particles having an average size of less than one micron.

5. A mixture to be used in coating a substantially uncontaminated dielectric glass film onto a substrate consisting essentially of the following ingredients in the following proportions:

| Constituents | Percent by Weight |
|---|---|
| linear polymethylmethacrylate | 4.7–19.2 |
| plasticizer | 2.3–9.1 |
| dielectric glass having a melting point above approximately 375° C. | 76.9–93.0 |

6. The mixture of claim 5 wherein said plasticizer is dibutyl phthalate.

7. The mixture of claim 5 further including a solvent consisting of ethyl glycol monoethyl ether acetate.

8. The mixture of claim 5 wherein said mixture consists of particles having an average size of less than one micron.

9. The mixture of claim 5 wherein the amount of plasticizer is in the range of approximately 20–51 percent of the amount of polymethylmethacrylate.

10. The mixture of claim 9 further including a solvent consisting essentially of ethyl glycol monoethyl ether acetate.

11. The mixture of claim 10 wherein said plasticizer is dibutyl phthalate.

* * * * *